US009108323B2

(12) United States Patent
Billado, Jr.

(10) Patent No.: US 9,108,323 B2
(45) Date of Patent: Aug. 18, 2015

(54) UTILITY KNIFE

(71) Applicant: Harry S. Billado, Jr., Newbury, NH (US)

(72) Inventor: Harry S. Billado, Jr., Newbury, NH (US)

(73) Assignee: GBH Products, LLC, Kingston, MA (US)

( * ) Notice: Subject to any disclaimer, the term of this patent is extended or adjusted under 35 U.S.C. 154(b) by 220 days.

(21) Appl. No.: 13/933,660

(22) Filed: Jul. 2, 2013

(65) Prior Publication Data

US 2014/0150268 A1 Jun. 5, 2014

Related U.S. Application Data

(60) Provisional application No. 61/668,014, filed on Jul. 4, 2012.

(51) Int. Cl.

| | |
|---|---|
| ***B26B 1/02*** | (2006.01) |
| ***B26B 5/00*** | (2006.01) |
| ***B26B 1/08*** | (2006.01) |

(52) U.S. Cl.

CPC . *B26B 5/001* (2013.01); *B26B 1/02* (2013.01); *B26B 1/08* (2013.01)

(58) Field of Classification Search

CPC . B26B 1/08; B26B 5/00; B26B 5/001–5/008; B26B 1/02

USPC ..... 30/1, 2, 151–162

See application file for complete search history.

(56) References Cited

U.S. PATENT DOCUMENTS

| | | | | |
|---|---|---|---|---|
| 2,284,128 | A * | 5/1942 | Bush | 30/335 |
| 2,523,575 | A * | 9/1950 | Kassel | 30/156 |
| 5,909,930 | A * | 6/1999 | Ragland et al. | 30/125 |
| 5,960,544 | A | 10/1999 | Beyers | |
| 6,349,473 | B1 * | 2/2002 | Schmidt | 30/162 |
| 6,354,007 | B1 | 3/2002 | Scarla | |
| 6,678,958 | B1 * | 1/2004 | Budrow | 30/125 |
| 6,915,577 | B2 * | 7/2005 | Scala | 30/156 |
| 7,007,392 | B2 | 3/2006 | Ping | |
| 7,020,969 | B2 * | 4/2006 | Roberson | 30/152 |
| 7,774,941 | B2 * | 8/2010 | Johnson et al. | 30/162 |
| 7,797,835 | B2 * | 9/2010 | Zeng | 30/153 |
| 7,797,836 | B2 * | 9/2010 | Ranieri et al. | 30/162 |

(Continued)

OTHER PUBLICATIONS

DeWalt (Stanley) You Tube Video published Mar. 15, 2011, "Dewalt Hand Tools Knife"; http://www.youtube.com/watch?v=2__0Y-s-FK-U&feature=related.

(Continued)

*Primary Examiner* — Sean Michalski

(74) *Attorney, Agent, or Firm* — Grossman, Tucker, Perreault & Pfleger, PLLC

(57) ABSTRACT

A utility knife configured to provide a user with a variety of configurations. The utility knife includes first and second handle members configured to move relative to one another between open (e.g. unfolded) and closed (e.g., folded) positions. The knife further includes a retractable blade within the second handle member. The retractable blade may be moved between a retracted position, wherein most, if not all, of the blade is maintained within the second handle member, and an extended position, wherein a portion of the blade is exposed. The knife is configured to allow the blade to be in retracted and extended positions when the first and second handle members are in either the unfolded or folded positions.

20 Claims, 3 Drawing Sheets

(56) References Cited

U.S. PATENT DOCUMENTS

| | | | | |
|---|---|---|---|---|
| 7,814,664 | B2 * | 10/2010 | LeBlanc et al. | 30/161 |
| 7,913,397 | B2 | 3/2011 | van Deursen | |
| 8,006,389 | B2 * | 8/2011 | Jennings et al. | 30/162 |
| 8,677,629 | B2 * | 3/2014 | Logan | 30/151 |
| 2003/0024123 | A1 * | 2/2003 | Liao | 30/162 |
| 2005/0144787 | A1 * | 7/2005 | Macri | 30/142 |
| 2005/0150116 | A1 * | 7/2005 | Johnson et al. | 30/162 |
| 2008/0110027 | A1 | 5/2008 | Seber et al. | |
| 2009/0193662 | A1 * | 8/2009 | van Deursen | 30/154 |
| 2010/0088899 | A1 * | 4/2010 | Garcia et al. | 30/123 |
| 2010/0223793 | A1 | 9/2010 | Hansen et al. | |
| 2011/0167647 | A1 * | 7/2011 | Gringer et al. | 30/156 |
| 2012/0023753 | A1 * | 2/2012 | Wen | 30/156 |
| 2012/0023754 | A1 * | 2/2012 | Chang | 30/162 |
| 2012/0036721 | A1 * | 2/2012 | McHenry et al. | 30/162 |
| 2012/0272529 | A1 * | 11/2012 | Constantine et al. | 30/162 |
| 2013/0055573 | A1 * | 3/2013 | Huhtala et al. | 30/151 |
| 2014/0053410 | A1 * | 2/2014 | Huang | 30/162 |
| 2014/0123501 | A1 * | 5/2014 | Jennings et al. | 30/162 |

OTHER PUBLICATIONS

Lenox (Irwin Tools) You Tube Video published Dec. 30, 2011; "Lenox Gold Folding Utility Knife Review"; http://www.youtube.com/watch?v=T9BQ7vWsVR8.

Charles & Hudson You Tube Video published Mar. 17, 2011; "Milwaukee Fastback Utility Knife"; http://www.youtube.com/watch?v=92lK_ylmEmk.

You Tube Video published Apr. 12, 2011; "Husky Folding Utility Knife"; http://www.youtube.com/watch?v=1EqGRUduCkl&feature=related.

* cited by examiner

UTILITY KNIFE

CROSS REFERENCE TO RELATED APPLICATIONS

The present non-provisional application claims the benefit of U.S. Provisional Patent Application Ser. No. 61/668,014, filed Jul. 4, 2012, the entire disclosure of which is incorporated herein by reference.

FIELD

The present disclosure relates to knives, and, more particularly, to a foldable utility knife having a retractable blade.

BACKGROUND

Utility knives are used in a variety of applications, such as carpentry, floor covering installations, hobby work, mechanical work, electrical work, etc. Currently, there are a variety of utility knives available. One common type of utility knife is of relatively simple construction, having a hollow handle serving as a housing for an internally housed retractable blade or a fixed blade that remains with cutting edge exposed. Another type of utility knife is a folding utility knife generally styled after well-known folding pocket knifes, also known as jackknives. Some folding utility knives may be closely related to "tactical" knives, which generally have a drop point, long hardened steel blade that folds into the handle. Some folding utility knives have fixed blades in a blade holder portion.

When the knife is transitioning into a folded position, the blade holder portion and blade generally pivot into the handle, wherein the blade remains exposed during this movement. Similarly, when unfolding the knife, the blade holder pivots out with the blade fully exposed. As such, the blade is exposed during the transition between folded and unfolded positions, which results in a safety hazard before and after use.

BRIEF DESCRIPTION OF THE DRAWINGS

Features and advantages of the claimed subject matter will be apparent from the following detailed description of embodiments consistent therewith, which description should be considered with reference to the accompanying drawings, wherein:

DETAILED DESCRIPTION

By way of overview, the present disclosure is generally directed to a foldable utility knife having a retractable blade. The utility knife includes a first handle member and a second handle member rotatably coupled to a portion of the first handle member and configured to move between a closed position and an open position relative to the first handle member. More specifically, a portion of the second handle member is configured to pivot relative to the first handle member between open and closed positions (e.g. unfolded and folded positions, respectively). When in a closed position, the second handle member pivots inwardly towards the first handle member and is received within a portion of the first handle member. When in an open position, the second handle member pivots outwardly away from the first handle member and extends from the first handle member generally along a similar planar surface, wherein the first and second handle members form an elongated handle.

The utility knife further includes a cutting blade moveable between a retracted position and an extended position relative to the second handle member. The second handle member includes an opening defined on a surface thereof extending from an exterior portion to a cavity formed within the second handle member. When the cutting blade is in the retracted position, a cutting surface of the cutting blade is positioned within the cavity of the second handle member. When moving from the retracted position to the extended position, a portion of the cutting blade extends out of the cavity and passes through the opening of the second handle member and a portion of the cutting surface is exposed for allowing cutting of a desired material. The cutting blade is moveable between the retracted and extended positions when the second handle member is in both the open and closed positions. Accordingly, a utility knife consistent with the present disclosure provides a variety of different handle and blade configurations for a variety of different cutting applications.

Figure 1:
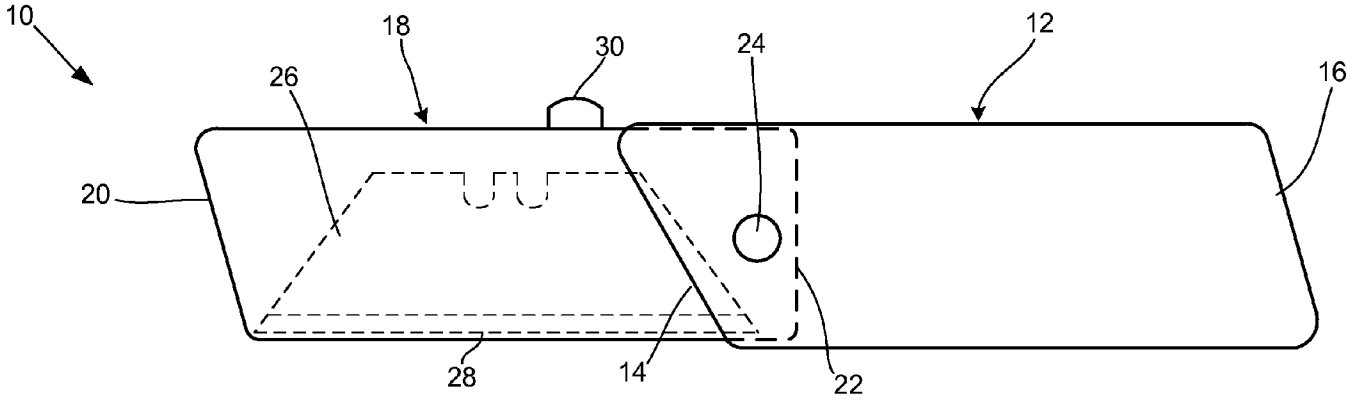
FIG. 1 is a side view of a folding utility knife in a fully open position according to one embodiment consistent with the present disclosure.

Turning to FIG. 1, a side view of a folding utility knife 10 according to one embodiment consistent with the present disclosure is generally illustrated. As shown, the knife 10 includes a first handle member 12 having a first end 14 and a second 16 and a second handle member 18 having a first end 20 and a second end 22. The first and second handle members 12, 18 are rotatably coupled to one another by way of a fastener 24. As shown, the first end 14 of the first handle member 12 is rotatably coupled to the second end 22 of the second handle member 18 by way of the fastener 24. The fastener 24 may serve as an axis about which the first and second handle members 12, 18 may rotate when coupled to one another. The knife 10 may be configured to move between a closed (e.g. folded) position (shown in FIGS. 4-5) and an open (e.g. unfolded) position, as shown. The first and second handle members 12, 18 rotate about the fastener 24 relative to one another in order to move into either the open position or the closed position, as will be described in greater detail herein.

In the illustrated embodiment, the second handle member 18 may be configured to house and retain a cutting blade 26 having a cutting surface 28 within a portion thereof. For example, the second handle member 18 may include a cavity (not shown) shaped and/or sized to receive and house the cutting blade 26. As may be appreciated, the cutting blade 26 may include any known blade for utility knives.

Figure 2:
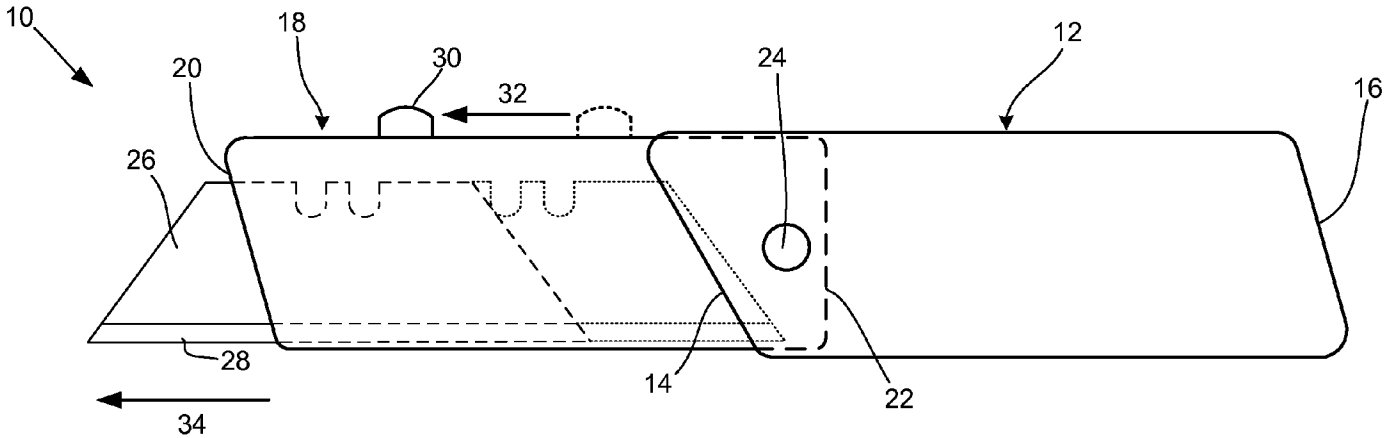
FIG. 2 is a side view of the knife of FIG. 1 showing the cutting blade moving from a retracted position to an extended position.

FIG. 2 is a side view of the knife 10 of FIG. 1 showing the cutting blade 26 moving from a retracted position to an extended position. As generally understood, second handle member 18 may include any known means of moving the cutting blade 26 from a retracted position, as shown in FIG. 1, to an extended position, as shown in FIG. 2. For example, the second handle member 18 may include a blade carrier (not shown) coupled to the cutting blade 26 and configured to receive user input from, for example, a button 30 coupled thereto. More specifically, the button 30 may allow a user to apply a force thereto and move (e.g. slide) the button 30 in a direction towards the first end 20 and way from the second end 22 of the second handle 18, as indicated by arrow 32. In turn, movement of the button 30 may cause the blade carrier and the blade 26 coupled thereto to move in a direction towards the first end 20 and away from the second end 22 of the second handle 18, as indicated by arrow 34 (e.g., from a retracted position to an extended position).

As generally understood, the first end 20 of the second handle 18 may include a slot (not shown) configured to allow the cutting blade 26 to move from within the interior of the second handle member 18 to the exterior. When in the retracted position, as shown in FIG. 1, the cutting surface 28 of the cutting blade 26 is contained within the second handle member 18 and when in the extended position, as shown in FIG. 2, the cutting surface 28 is exposed, thereby allowing the user to cut desired materials. As may be appreciated, a user may move the cutting blade 26 from the extended position to the retracted position by moving the button 30 generally in a direction towards the second end 22 of the second handle member 18.

As may be appreciated, the knife 10 may be configured to house a reserve of extra cutting blades for storage. Additionally, as generally understood, the knife 10 may include any known mechanism for relatively quick and simple blade exchange. For example, in one embodiment, the knife 10 may include a feeding structure or device for easily pushing or feeding or changing a spare cutting blade from a reserve of blades stored internally within the knife 10 into the blade carrier without the need to open either of the first or second handle members 12, 18. In another embodiment, the knife 10 may include a mechanism for releasably coupling the blade 26 to the carrier and allowing a user to release the blade 26 in exchange for another.

Figure 3:
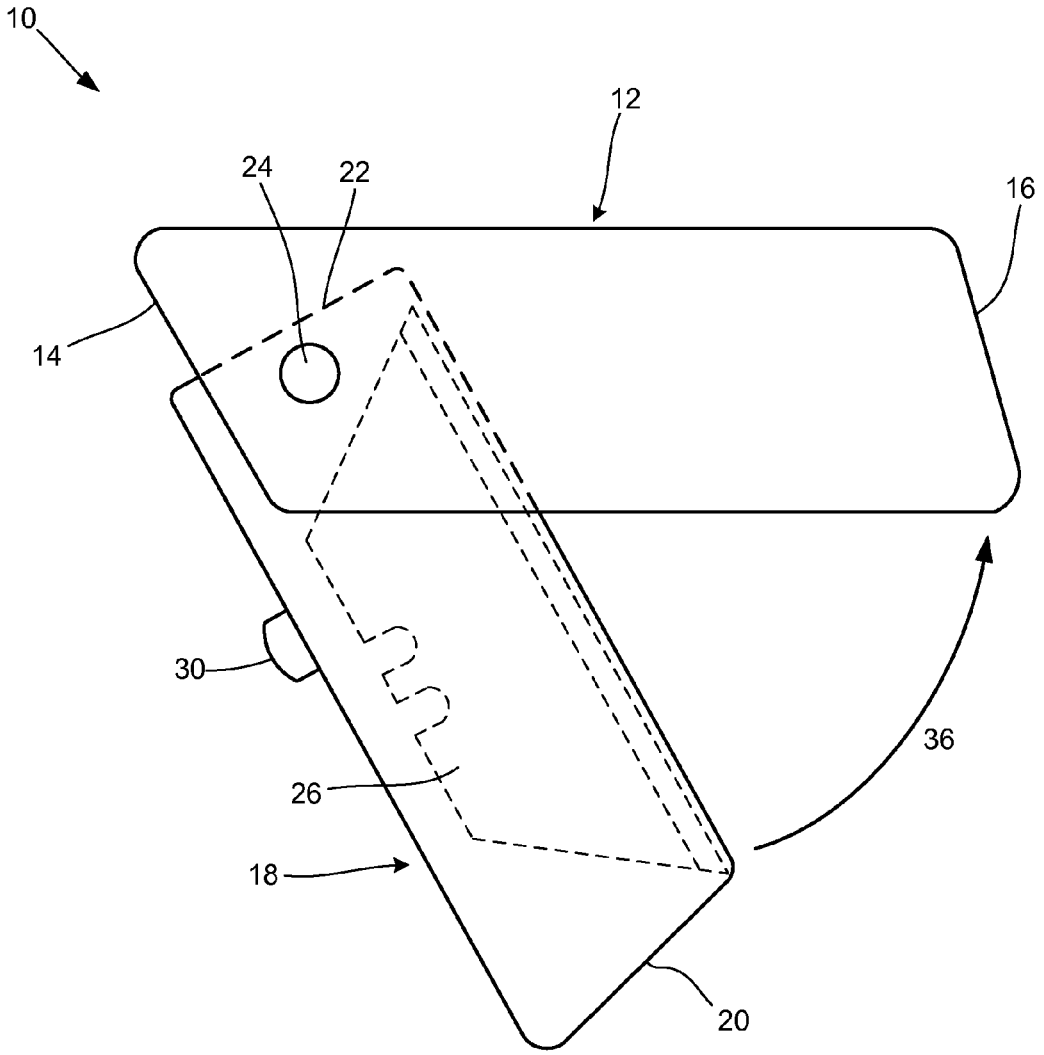
FIG. 3 is a side view of the knife of FIG. 1 showing the first and second handle members moving from an open position to closed position.

FIG. 3 is a side view of the knife 10 showing the first and second handle members 12, 18 moving from an open position (e.g., unfolded) to closed position (e.g. folded). As previously described, the knife 10 may be configured to move between closed and open positions. When moving between the closed and open positions, the first and second handle members 12, 18 rotate about the fastener 24 relative to one another. As may be appreciated, the first handle member 12 may include a cavity (not shown) shaped and/or sized to receive a portion of the second handle member 18, such that, when moving from the open position to the closed position, as indicated by arrow 34, a portion of the second handle member may be received within the first handle member 12.

As generally understood by one skilled in the art, the utility knife 10 may include any known means of maintaining the first and second handle members 12, 18 in the open and closed positions. For example, the knife 10 may include a known locking mechanism (not shown) configured to lock the first and second handle members 12, 18 in the open position and/or lock the first and second handle members 12, 18 in the closed position. As may be appreciated, the locking mechanism may further be configured to allow the user to selectively release (e.g., unlock) the first and second handle members 12, 18 and allow the knife to transition between open and closed positions.

Figure 4:
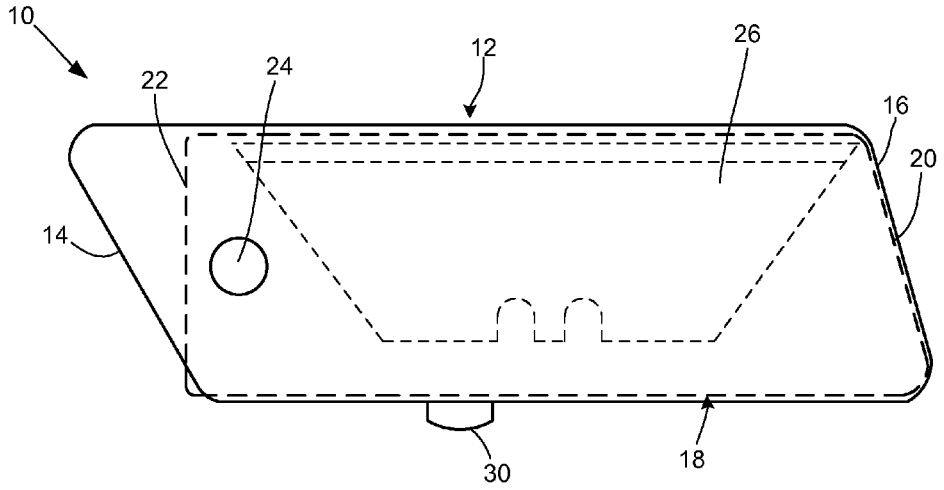
FIG. 4 is a side view of the knife of FIG. 1 in a fully closed position.

FIG. 4 is a side view of the knife 10 in a fully closed position. As shown, a substantial portion of the second handle member 18 may be received and housed within the first handle member 12 when in a closed position. In the illustrated embodiment, when in a closed position, the first end 20 of the second handle member 18 may be adjacent the second end 16 of the first handle member 12. The first and second handle members 12, 18 may be correspondingly shaped and/or sized, such that, when in a closed position, the second handle member 18 is completely, or almost nearly completely, enclosed within the first handle member 12.

Figure 5:
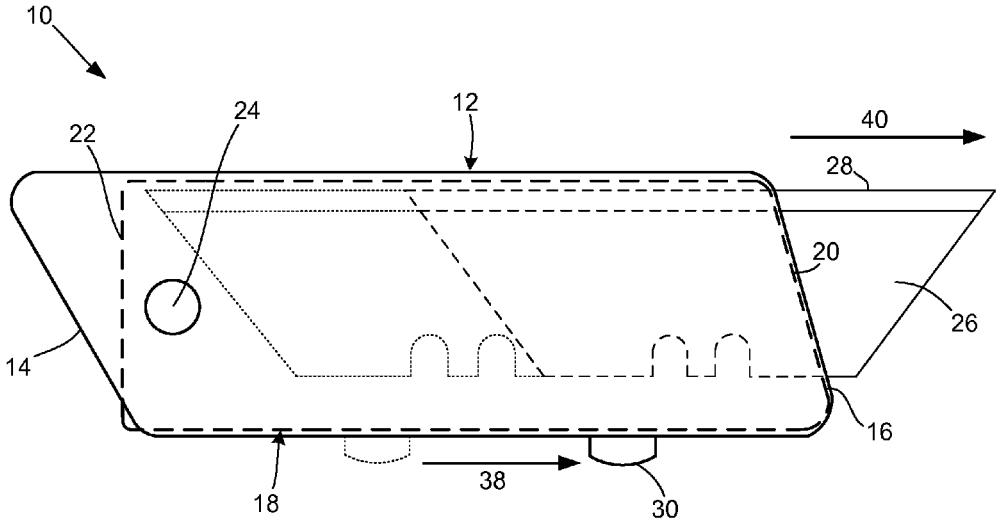
FIG. 5 is a side view of the knife of FIG. 1 in a fully closed position showing the cutting blade moving from a retracted position to an extended position.

FIG. 5 is a side view of the knife 10 in a fully closed position illustrating the cutting blade 26 moving from the retracted position to an extended position. Similar to FIG. 2, in which a user may move the cutting blade 26 from a retracted position to an extended position when the knife 10 is in an open position, the user may also move the cutting blade 26 between retracted and extended positions when the knife 10 is in the closed position. As shown, the user need only move the button 30 in a direction away from the second end 22 of the second handle member 20, as indicated by arrow 38. In turn, movement of the button 30 may cause the blade 26 to move in a direction towards the first end 20 and away from the second end 22 of the second handle 18, as indicated by arrow 40, from a retracted position to an extended position. As generally understood, the second end 16 of the first handle member 12 may include a slot (not shown) configured to allow the cutting blade 26 to move from the first end 20 of the second handle member 18 to the exterior, thereby exposing the cutting surface 28 of the blade 26 and allowing the user to cut desired materials.

Accordingly, the utility knife 10 is configured to provide a user with a variety of cutting configurations. More specifically, the knife 10 may allow a user to extend and retract the blade 26 while in both an open (e.g., unfolded) position and a closed (e.g., folded) position. The ability to have the cutting surface 28 of the blade 26 exposed and ready for cutting operation in either the open or closed positions may be advantageous depending on the intended use. For example, when in an open position, the first and second handle members 12, 18 may form a larger overall handle which may provide the user with more leverage and improved grip, which may particularly useful in heavy cutting applications. When in the closed position, the first and second handle members 12, 18 may form a more compact overall handle (i.e. approximately half of the size of the handle in an open position), which may be better adapted for simple cutting tasks.

According to one aspect of the present disclosure, there is provided a utility knife. The utility knife includes a first handle member and a second handle member rotatably coupled to a portion of the first handle member and configured to move between a folded position and an unfolded position relative to the first handle member. The second handle member has a cavity defined within and an opening extending from the cavity to an exterior portion of the second handle member. The utility knife further includes a blade configured to be moved between a retracted position and an extended position. When in the retracted position, the blade is positioned within the cavity of the second handle member and, when in the extended position, a portion of the blade extends through the opening of the second handle member and is exposed. The blade is configured to be moved between the retracted and extended positions when the second handle member is in at least one of the folded and unfolded positions.

According to another aspect of the present disclosure, there is provided a utility knife. The utility knife includes a first handle member and a second handle member rotatably coupled to a portion of the first handle member by way of a fastener and configured to rotate about the fastener between a folded position and an unfolded position relative to the first handle member. The second handle member has a cavity defined within and an opening extending from the cavity to an exterior portion of the second handle member. The utility knife further includes a cutting blade configured to be moved between a retracted position and an extended position. When in the retracted position, a cutting surface of the cutting blade is positioned within the cavity of the second handle member and when in the extended position, a portion of the cutting blade extends through the opening of the second handle member and a portion of the cutting surface is exposed to allow cutting of a material. The cutting blade is configured to be moved between the retracted and extended positions when the second handle member is in at least one of the folded and unfolded positions.

According to yet another aspect of the present disclosure, there is provided a utility knife. The utility knife includes a first handle member having a first end and an opposing second end and a cavity formed within a portion thereof and a second handle member having a first end and an opposing second end rotatably coupled to the first end of the first handle member by way of a fastener. The second handle member is configured to rotate about the fastener between a folded position and an unfolded position relative to the first handle member. The second handle member has an opening defined on the first end and extending from an exterior portion to a cavity formed within the second handle member. The utility knife further includes a cutting blade positioned within the cavity of the second handle member and configured to be moved between a retracted position and an extended position. When in the retracted position, a cutting surface of the cutting blade is entirely positioned within the cavity of the second handle member and when in the extended position, a portion of the cutting blade extends through the opening of the second handle member and a portion of the cutting surface is exposed to allow cutting of a material. The cutting blade is configured to be moved between the retracted and extended positions when the second handle member is in either the folded position or the unfolded position.

While several embodiments of the present disclosure have been described and illustrated herein, those of ordinary skill in the art will readily envision a variety of other means and/or structures for performing the functions and/or obtaining the results and/or one or more of the advantages described herein, and each of such variations and/or modifications is deemed to be within the scope of the present disclosure. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings of the present disclosure is/are used. Those skilled in the art will recognize, or be able to ascertain using no more than routine experimentation, many equivalents to the specific embodiments of the disclosure described herein. It is, therefore, to be understood that the foregoing embodiments are presented by way of example only and that, within the scope of the appended claims and equivalents thereto, the disclosure may be practiced otherwise than as specifically described and claimed. The present disclosure is directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Other elements may optionally be present other than the elements specifically identified by the "and/or" clause, whether related or unrelated to those elements specifically identified, unless clearly indicated to the contrary.

What is claimed is:

1. A utility knife comprising:

a first handle member;

a second handle member rotatably coupled to a portion of said first handle member and configured to move between a folded position and an unfolded position relative to said first handle member, said second handle member having a cavity defined within and an opening extending from said cavity to an exterior portion of said second handle member; and a blade configured to be moved between a retracted position and an extended position, wherein, when in said retracted position, said blade is positioned within said cavity of said second handle member and, when in said extended position, a portion of said blade extends through said opening of said second handle member and is exposed;

wherein said blade is configured to be moved between said retracted and extended positions when said second handle member is in at least one of said folded and unfolded positions.

2. The utility knife of claim 1, wherein said first and second handle members are rotatably coupled to one another by way of a fastener.

3. The utility knife of claim 2, wherein said second handle member is configured to rotate about said fastener between said folded and unfolded positions.

4. The utility knife of claim 1, wherein, when transitioning from said unfolded position to said folded position, said second handle member is configured to rotate inwardly in a direction towards said first handle member and be received within a cavity defined in said first handle member.

5. The utility knife of claim 4, wherein said second handle member is entirely received and enclosed within said cavity of said first handle member when in said folded position.

6. The utility knife of claim 4, wherein, when transitioning from said folded position to said unfolded position, said second handle member is configured to rotate outwardly in a direction away from said cavity defined in said first handle member and extend from said first handle member.

7. The utility knife of claim 4, wherein at least one of said cavities of said first and second handle members is configured to store one or more additional blades within.

8. The utility knife of claim 1, wherein said first handle member has a first end and an opposing second end and said second handle member has a first end and an opposing second end, wherein said first end of said first handle member is rotatably coupled to said second end of said second handle member.

9. The utility knife of claim 8, wherein said opening is defined on said first end of said second handle member.

10. The utility knife of claim 1, further comprising a means for allowing a user to selectively move said blade between said retracted and extended positions and positions therebetween.

11. The utility knife of claim 1, further comprising a blade carrier slidably received within said cavity of said second handle member, said blade carrier configured to support said cutting blade and to move said cutting blade between said retracted and extended positions.

12. A utility knife comprising:

a first handle member;

a second handle member rotatably coupled to a portion of said first handle member by way of a fastener and configured to rotate about said fastener between a folded position and an unfolded position relative to said first handle member, said second handle member having a cavity defined within and an opening extending from said cavity to an exterior portion of said second handle member; and a cutting blade configured to be moved between a retracted position and an extended position, wherein, when in said retracted position, a cutting surface of said cutting blade is positioned within said cavity of said second handle member and when in said extended position, a portion of said cutting blade extends through said opening of said second handle member and a portion of said cutting surface is exposed to allow cutting of a material;

wherein said cutting blade is configured to be moved between said retracted and extended positions when said second handle member is in at least one of said folded and unfolded positions.

13. The utility knife of claim 12, wherein said first handle member comprises a cavity shaped and/or sized to receive at least a portion of said second handle member within.

14. The utility knife of claim 13, wherein at least one of said cavities of said first and second handle members is configured to store one or more additional blades within.

15. The utility knife of claim 13, wherein, when transitioning from said unfolded position to said folded position, said second handle member is configured to rotate inwardly in a direction towards said first handle member and be received within said cavity of said first handle member and wherein, when transitioning from said folded position to said unfolded position, said second handle member is configured to rotate outwardly in a direction away from said cavity of said first handle member and extend from said first handle member, wherein said first and second handle members form a substantially elongated handle.

16. The utility knife of claim 15, wherein said second handle member is entirely received and enclosed within said cavity of said first handle member when in said closed position.

17. The utility knife of claim 12, further comprising a blade carrier slidably received within said cavity of said second handle member, said blade carrier configured to support said cutting blade and to move said cutting blade between said retracted and extended positions.

18. A utility knife comprising:

a first handle member having a first end and an opposing second end and having a cavity formed within a portion thereof;

a second handle member having a first end and an opposing second end rotatably coupled to said first end of said first handle member by way of a fastener, said second handle member being configured to rotate about said fastener between a folded position and an unfolded position relative to said first handle member, said second handle member having an opening defined on said first end and extending from an exterior portion to a cavity formed within said second handle member; and a cutting blade positioned within said cavity of said second handle member and configured to be moved between a retracted position and an extended position, wherein, when in said retracted position, a cutting surface of said cutting blade is entirely positioned within said cavity of said second handle member and when in said extended position, a portion of said cutting blade extends through said opening of said second handle member and a portion of said cutting surface is exposed to allow cutting of a material;

wherein said cutting blade is configured to be moved between said retracted and extended positions when said second handle member is in either said folded position or said unfolded position.

19. The utility knife of claim 18, wherein at least one of said cavities of said first and second handle members is configured to store one or more additional blades within.

20. The utility knife of claim 18, further comprising:

a means for allowing a user to selectively move said blade between said retracted and extended positions and positions therebetween; and a blade carrier slidably received within said cavity of said second handle member and coupled to said means for allowing selective movement of said blade, said blade carrier configured to support said cutting blade and to move said cutting blade between said retracted and extended positions.

* * * * *